United States Patent [19]

Ishikawa

[11] 4,051,664

[45] Oct. 4, 1977

[54] DRIVE CIRCUIT OF LIGHT EMITTING MEANS FOR LIQUID CRYSTAL ELECTRONIC WATCH

[75] Inventor: Takehiro Ishikawa, Tokyo, Japan

[73] Assignee: Kabushiki Kaisha Daini Seikosha, Japan

[21] Appl. No.: 719,102

[22] Filed: Aug. 31, 1976

[30] Foreign Application Priority Data

Sept. 9, 1975 Japan ..... 50-109322

[51] Int. Cl.[2] ..... G04B 19/34

[52] U.S. Cl. ..... 58/50 R; 58/23 BA

[58] Field of Search ..... 58/23 BA, 23 R, 50 R, 58/4 A, 153

[56] References Cited

U.S. PATENT DOCUMENTS

| | | | |
|---|---|---|---|
| 3,855,784 | 12/1974 | Foellner | 58/50 R |
| 3,898,790 | 8/1975 | Takamune et al. | 58/23 BA |
| 3,911,665 | 10/1975 | Van Berkum | 58/50 R |
| 3,962,859 | 6/1976 | Ito | 58/50 R X |

*Primary Examiner*—Ulysses Weldon

*Attorney, Agent, or Firm*—Robert E. Burns; Emmanuel J. Lobato; Bruce L. Adams

[57] ABSTRACT

Light emitting means for illuminating the liquid crystal display of an electronic watch is energized by alternating current rather than direct. The alternating current is supplied by an AND circuit having one input connected to a terminal of the battery which powers the watch and another input connected to an output of selected frequency of the usual frequency divider of the watch. The output of the AND circuit is amplified by a buffer amplifier having a current gain element and the amplified output is fed to a transistor driver for the light emitting means which may be a lamp or a light emitting diode. The use of alternating current lessens the drain on the battery and thereby prolongs battery life.

5 Claims, 2 Drawing Figures

DRIVE CIRCUIT OF LIGHT EMITTING MEANS FOR LIQUID CRYSTAL ELECTRONIC WATCH

FIELD OF INVENTION

The present invention relates to a liquid crystal electronic watch and particularly to a drive circuit for light emitting means for illuminating the liquid crystal display.

BACKGROUND OF INVENTION

A liquid crystal electronic watch has the disadvantage that the liquid crystal display device has no light emitting characteristics and it is hence difficult or impossible to read the time display at night or under low light conditions. Hence, in the conventional liquid crystal electronic watch, a lamp or light emitting diode is employed for illuminating the liquid crystal display device so that it can be read in the dark. However, such illuminating means has the disadvantage of imposing a drain on the battery by which the watch is powered. For example, at an applied voltage of 1.5 V, the current consumption of such an illuminating device is about 10 mA. As the current capacity of a silver cell commonly employed for an electronic watch is only about 100 mA–150 mA the ratio of power consumption by such illuminating means is relatively large. It is hence necessary frequently to change the battery cell.

SUMMARY OF INVENTION

It is an object of the present invention to eliminate the above noted difficulties and disadvantages. In accordance with the invention, the light emitting means for the liquid crystal display device of an electronic watch is driven by alternating current rather than direct current so as to achieve a significant reduction in the power consumption of the light emitting element for the liquid crystal electronic watch. The battery life is thereby significantly increased.

BRIEF DESCRIPTION OF DRAWINGS

The nature, objects and advantages of the invention will be more fully understood from the following description of a preferred embodiment illustrated by way of example in the accompanying drawings, in which.

DESCRIPTION OF PREFERRED EMBODIMENT

Figure 1:
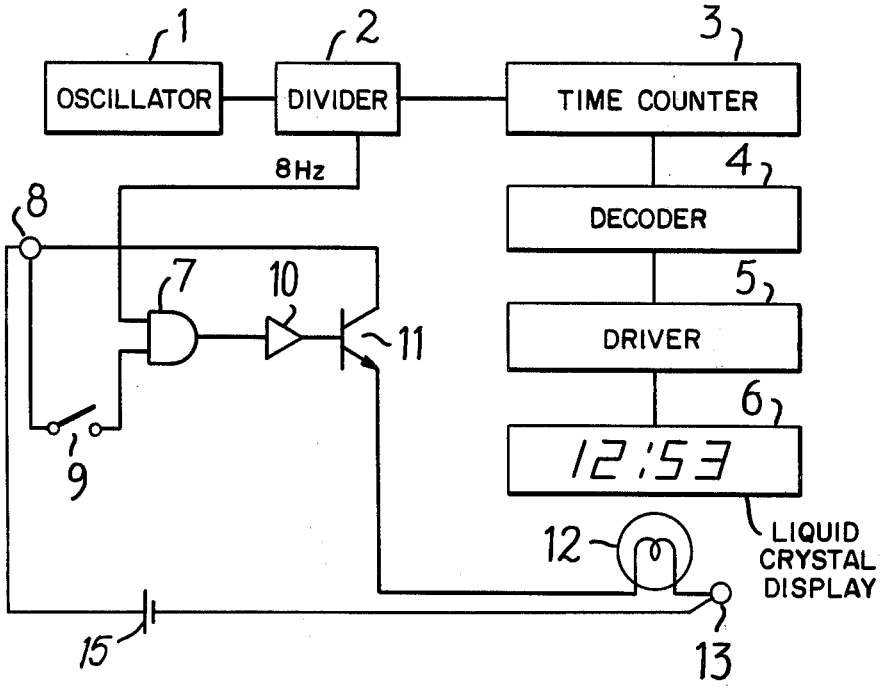
FIG. 1 is a circuit diagram of a liquid crystal electronic watch having illuminating means in accordance with the present invention.

The circuitry of an electronic watch having a liquid crystal display and illuminating means in accordance with the invention is illustrated schematically in FIG. 1. The oscillatory output signal generated by an oscillating circuit 1 having a quartz element is divided by a dividing circuit 2 to provide a standard time signal of predetermined frequency. The divided signal is applied to a time counter 3 comprising a minute counter, hour counter and so on. The counted content generated by the time counter 3 is changed to a suitable code for display by a decoder 4 and is applied to a driver 5. The output of the decoder 4 is amplified by the driver 5 and the amplified signal is applied to a liquid crystal display device 6. As the circuitry so far described is well known, a more detailed description is believed to be unnecessary.

In accordance with the present invention, means is provided for illuminating the liquid crystal display 6 by a light emitting means which is powered by alternating current. A signal of selected frequency, for example 8 Hz supplied by a second output of the dividing circuit 2 is applied to one input terminal of a two input type AND circuit 7. The other input of the AND circuit 7 is connected through a switch 9 to the high voltage point 8 of the dc power supply of the watch — normally a silver battery cell 15—. The output of the AND circuit 7 is applied to the base electrode of a transistor 11 through a buffer amplifier 10 having a current gain element. The collector of the transistor 11 is connected to the high voltage point 8 of the power voltage while the emitter of the transistor 11 is connected to one terminal of a lamp 12 as a light emitting means for illuminating the liquid crystal display device 6. The other terminal of the lamp 12 is connected to the low voltage point 13 of the power voltage.

Figure 2:
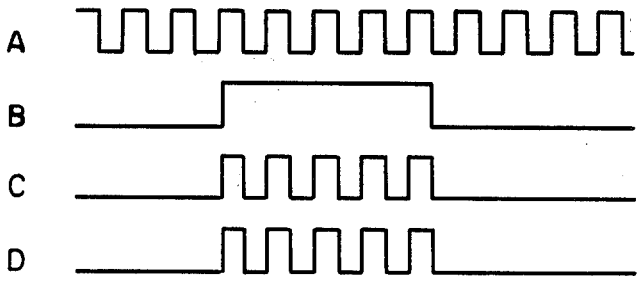
FIG. 2 shows a wave form for explaining the circuit of FIG. 1.

The operation of the embodiment of the invention illustrated in FIG. 1 will now be explained with reference to the accompanying wave forms shown in FIG. 2. As the operation of the time keeping circuit is conventional, an explanation of such operation is here omitted. The divided signal of for example 8 Hz as indicated in the wave form A is derived from the dividing circuit 2 and is applied to one terminal of the AND circuit 7. When the switch 9 is operated to ON position for illuminating the liquid display device 6, the other input terminal of the AND circuit 7 is changed from logic [0] to logic [1]. As long as the switch 9 is maintained in ON position as indicated in wave form B, a signal of 8 Hz is generated from the AND circuit 7 as indicated by the wave form C. This 8 Hz signal is amplified by the buffer amplifier 10 and is applied to the base electrode of the transistor 11. The transistor 11 hence performs a switching operation in response to the applied signal so as to generate a signal wave of wave form D from the emitter electrode. This signal is applied to the lamp 12 whereby the lamp is operated by the alternating current.

The present invention is in no way limited to the embodiment described above as it is possible to modify and improve the construction. For example, instead of a lamp for illuminating the liquid crystal display device 6, it is possible to utilize a light emitting diode. Moreover, it is possible to use other frequencies derived from the dividing circuit 2, for example frequencies in the range from 3 Hz to 100 Hz.

It will thus be seen that according to the present invention, the light emitting means for illuminating the liquid crystal display device of an electronic watch is driven by alternating current whereby the power consumption of the light emitting means is reduced by half. It is hence not necessary to change the battery cell frequently despite frequent use of light emitting means.

What I claim is:

1. In a liquid crystal all electronic watch comprising an oscillating circuit, a frequency dividing circuit for dividing a signal obtained from said oscillating circuit, a time counter for counting an output signal of said frequency dividing circuit, a liquid crystal time display means, a decoder and driver for converting the time signals from said counter and displaying them by said liquid crystal display means, and a battery for supplying power for operating said electronic watch; auxiliary means for illuminating said liquid crystal time display means comprising means for generating an alternating current of selected frequency, light emitting means positioned for illuminating said liquid crystal time display means and control means for temporarily supplying alternating current from said generating means to said light emitting means only when it is desired to illuminate said crystal time display means, said alternating current generating means comprising an AND circuit having two inputs and one output, means for connecting one input of said AND circuit to an output of selected frequency of said frequency dividing circuit, means for connecting the other input of said AND circuit to terminal of said battery, and means for amplifying the current output of said AND circuit and applying the amplified output to said light emitting means.

2. Means for illuminating the liquid crystal display means of an electronic watch according to claim 1, in which said current amplifying means comprises a transistor driver for said light emitting means and a buffer amplifier connecting the output of said AND circuit with said transistor driver.

3. Means for illuminating the liquid crystal display means of an electronic watch according to claim 1, in which said light emitting means is a light emitting diode.

4. Means for illuminating the liquid crystal display means of an electronic watch according to claim 1, in which said light emitting means is a lamp.

5. Means for illuminating the liquid crystal display means of an electronic watch according to claim 1, in which said frequency dividing circuit has one output connected to said time counter and a second output connected to an input of said AND circuit, the frequency of said second output being between 3 Hz and 100 Hz.

* * * * *